US005913367A

United States Patent [19]

Hampton

[11] Patent Number: 5,913,367

[45] Date of Patent: Jun. 22, 1999

[54] AIRCRAFT PENETRATOR

[76] Inventor: Lawrence M. Hampton, 1608 Grant Ave., Linwood, N.J. 08221

[21] Appl. No.: 08/708,216

[22] Filed: Sep. 6, 1996

[51] Int. Cl.[6] ..... A62C 31/22

[52] U.S. Cl. ..... 169/70; 169/62; 239/251

[58] Field of Search ..... 169/62, 70; 239/251, 239/259, 271, 272

[56] References Cited

U.S. PATENT DOCUMENTS

| | | | |
|---|---|---|---|
| 2,698,200 | 12/1954 | Bottos | 239/251 |
| 2,813,753 | 11/1957 | Roberts | 169/70 X |
| 2,993,650 | 7/1961 | Badberg | 239/271 |
| 4,219,084 | 8/1980 | Gray et al. | 169/70 X |
| 5,301,756 | 4/1994 | Relyea et al. | 169/70 X |

*Primary Examiner*—Andrew C. Pike
*Attorney, Agent, or Firm*—Eric P. Schellin

[57] ABSTRACT

An aircraft penetrating nozzle comprises a penetrator which has a harden tip. The penetrator functions to open a passageway in a barrier or skin of an aircraft to permit the aircraft penetrating nozzle to pass thereinto. The penetrator is securely attached to a frustum which comprises a plurality of nozzles which disperse fire extinguishing fluids interior to the aircraft perpendicular to the longitudinal axis of the aircraft penetrating nozzle and forward of the perpendicular. The frustum is securely attached to a shank which comprises at least one rotating nozzle which functions to disperse fire extinguishing fluid, in fog form, sideways to the aircraft penetrating nozzle which is fore and aft in the aircraft. The aircraft penetrating nozzle is attached to a boom and a fire extinguishing fluid source.

3 Claims, 5 Drawing Sheets

AIRCRAFT PENETRATOR

BACKGROUND OF THE INVENTION

1. Field of the Invention

The present invention relates to fire extinguishing apparatus. More particularly, the present invention relates to a nozzle having a penetrating head which is used to penetrate barriers such as the skin of an aircraft.

2. Description of the Prior Art

Prior art inventions describe fire extinguishing apparatus designed to penetrate the skin of an aircraft or other type of a barriers. Once the barrier has been penetrated fire extinguishing agent is exhausted through a nozzle means on the end of the penetrator. Pointed nozzles have been used in the past, in particular one which utilizes a point end to penetrate the barrier by the user driving it through the barrier by means of an attached slide hammer. Explosive means have been attempted to overcome the force required to penetrate a barrier; however, the explosive device cannot be used in an explosive atmosphere such as that of an aircraft or spacecraft fire. A spring-loaded and fired device is described in Barge (U.S. Pat. No. 4,124,077). Research has shown that handheld penetrators cannot be used off a ladder without endangering the firefighter.

A fogging spray pattern has been found to be very effective in extinguishing fires and has the advantage that it is not under high pressure once it exits the nozzle. This allows a person to maneuver very close to the nozzle with out being hampered by the effects of the water pressure. The spray pattern of the prior art is created by straight jet orifice nozzles distributed around a head end. The straight jet orifice nozzles create straight streams which can miss the fire altogether. Research into aircraft fires has discovered that a fore-and-aft dispersion of a fogging type spray is the most effective in extinguishing interior fires.

Numerous innovations for Aircraft Penetrator have been provided in the prior art that are described as follows. Even though these innovations may be suitable for the specific individual purposes to which they address, they differ from the present invention as hereinafter contrasted.

In U.S. Pat. No. 5,409,067, titled Portable fire fighting tool, invented by John Esposito and Norman E. Atwater, a portable fire fighting tool that is connectable to a portable fire extinguisher is described. This tool comprises a penetrating head with a removable, sharp cutting element thereon and wherein the penetrating head is preferably connected at 90° to a linear, hollow handle. At the opposite end of the handle a quick connect device may be used to connect a portable fire extinguisher and the handle together. This tool is especially useful in fighting an automobile or truck engine or trunk compartment fire when the automobile or truck is locked preventing entry into the engine compartment or the trunk. By forcing the penetrating head down and through the sheet metal of the engine or trunk compartment, the cutting element cuts through the sheet metal. When the fire extinguisher is discharged, the fire extinguishing agent (e.g., foam, water, dry chemical, Halon or $CO_2$) flows down over the cutting element in an umbrella-like fashion extinguishing the fire without doing further damage to the automobile or truck.

The patented invention differs from the present invention because the patented invention is used with a portable extinguishing system which is of low volume. The patented invention has one nozzle which exhausts fluids under low pressure within a small confined area. The patented invention does not have a fogging nozzle. The present invention attaches to a mechanical boom which provides the penetration force and a high pressure source of fluids. The present invention has several fogging nozzles which direct fluid in multiple direction.

In U.S. Pat. No. 5,368,106, titled Fire-fighting tool particularly for shipboard fires and the like, invented by Jerome A. Coughlin, a fire tool consists of a nozzle section having a penetrator section at the end and an attachment section at the bottom for attachment to an extensible hydraulic ram. The ram has a base adapted to be secured to a horizontal surface such as the deck of a ship next to a vertical surface such as a bulkhead in such ship and the entire unit is leaned against the bulkhead with a specially designed point against such bulkhead. The hydraulic ram is then activated to force the tip of the penetrator into the bulkhead and ultimately through the bulkhead, after which water may be sprayed into the area behind the bulkhead where a fire may be burning through spray orifices in the nozzle section, the water being injected into the nozzle section through a fitting on the opposite side of the bulkhead from the spray orifices. The arrangement of the fire-fighting tool at an angle between the deck and the bulkhead assures that there will invariably be a rigid surface available for enabling pressure of the hydraulic ram to be exerted forcefully enough on the end of the penetrator section to breach the wall or bulkhead. The point of the penetrator is designed so that it will dig into the wall surface efficiently and effectively even though it is applied to such wall surface at an angle.

The patented invention differs from the present invention because the patented invention is a hydraulic ram which must be anchored to a structurally sound member. The hydraulic ram pushes against the structure which drives the point through a bulkhead. The present invention is portable and does not require a secure structure to brace against; it is mounted onto a boom from a fire truck.

In U.S. Pat. No. 5,062,486, titled Firefighter's Barrier Penetrator and Agent Injector, invented by Charles H. McClenahan, a firefighter's barrier penetrator and agent injector has an extendible slide rod to guide a slide hammer to strike a penetrating body to drive its point through the barrier. The slide rod can be retracted into the body to minimize the length of the penetrator while being carried. A nozzle is slidably mounted in the body to be extendible into the structure for injection purposes, again to minimize the carrying length. Retention devices releasable hold the rod and nozzle in their retracted positions.

The patented invention differs from the present invention because the patented invention is a handheld penetrator having a slide hammer means to drive the pointed tip through the skin of an aircraft. The user must hold the penetrator and simultaneously slide the hammer back and forth to drive the tip through the aircraft skin. Orifices are not fogging and no orifices are placed in the tip projecting along the axis. The present invention attaches to a mechanical boom which provides the penetration force and a high pressure source of fluids. The present invention has several fogging nozzles which direct fluid in multiple directions.

In U.S. Pat. No. 4,219,084, titled Fire Extinguishing Apparatus Having a Slidable Mass for a Penetrator Nozzle, invented by Robert A. Frosch, Norris C. Gray, Robert M. Senseny, and Philip N. Bolton, a fire extinguishing apparatus delivers an extinguishing agent through a barrier surrounding a structure into the interior thereof. The apparatus includes an elongated tubular nozzle body which has a pointed penetrating head carried on one end of the tubular body. A source of extinguishing agent is coupled to the opposite end of the tubular body and is fed therethrough and passes through passages adjacent the head for delivering the extinguishing agent to the interior of the structure. A slidable mass is carried on the tubular body on a remote end of the tubular body from the penetrating head. By manipulating the slidable mass and bringing such in contact with an abutment the force imparted to the tubular body causes the head to penetrate the structure.

The patented invention differs from the present invention because the patented invention is a handheld penetrator having a slide hammer means to drive the pointed tip through the skin of an aircraft. The user must hold the penetrator and simultaneously slide the hammer back and forth to drive the tip through the aircraft skin. The patented invention has nozzles which project streams of fluid but do not produce a fogging spray. The present invention attaches to a mechanical boom which provides the penetration force and a high pressure source of fluids. The present invention has several fogging nozzles which direct fluid in multiple directions.

In U.S. Pat. No. 4,147,216, titled Penetrator/nozzle Arrangement, invented by Robert W. Schnepfe, Jr., and Laban R. Lowe, Sr., a penetrator/nozzle arrangement, particularly for enabling fighting of fires in aircraft and other difficult access target units, has a telescopic nozzle formed by a spray nozzle tube section telescopically slidable on a concentric feed tube, with a cylindrical cutter mounted for sliding movement about the nozzle and toward a target unit. A cartridge is fired to drive the cutter toward the forward spray end of the nozzle, thereby cutting the effective skin of a target and enabling the nozzle to be moved therethrough with its forward spray discharge end extending into the target interior zone for passage of fluid, powder, or other desired agent through the nozzle into the target interior.

The patented invention differs from the present invention because the patented invention uses a cartridge to drive a cutter through a barrier. Because of the explosive nature of the cartridge this device is not acceptable for use in an explosive environment. The present invention does not use an explosive cartridge to penetrate the skin of the aircraft. The present invention is mounted onto a boom and is not handheld as is the patented invention.

In U.S. Pat. No. 4,124,077, titled Sprinkler Head with Wall Penetrating Means, invented by Timothy T. Barge, a sprinkler head for use in residential areas, or the like, requiring the maintenance of aesthetic appearance, includes a bayonet impacted by a spring-biased power sleeve for penetrating an interior ceiling or wall. The power sleeve is restrained in the ready position by a wire cable having a rupturable portion separable by heat or other means controlled by a remote device for sensing in incendiary condition in the space to be fire-protected on the opposite side of the ceiling or wall from the sprinkler head.

The patented invention differs from the present invention because the patented invention is a sprinkler head concealed in a wall or ceiling. It provides for a cosmetically pleasing method to hide the common sprinkler heads. It does not penetrate any barrier or skin but a specific barrier designed to be penetrated. Penetration is achieved by a spring member which forces a tip through a thin barrier. The present invention penetrates the structural skins of aircraft and other barriers. It is not designed to be concealed within a ceiling or wall. The present invention attaches to a mechanical boom which provides the penetration force and a high pressure source of fluids. The present invention has several fogging nozzles which direct fluid in multiple directions.

Numerous innovations for Aircraft Penetrator have been provided in the prior art that are adapted to be used. Even though these innovations may be suitable for the specific individual purposes to which they address, they would not be suitable for the purposes of the present invention as heretofore described.

SUMMARY OF THE INVENTION

Numerous tools exist that are designed to penetrate buildings and aircraft, then extinguish interior fires. The tools penetrate by ramming or drilling a tip through the barrier. The prior art typically has straight jets which exhaust the fluids in a straight stream. It has been determined that a fog type of fluid spray is most effective in extinguishing interior fires.

The types of problems encountered in the prior art are that straight streams of fluid may not hit the fire. Further the force necessary to penetrate the skin of an aircraft or a barrier is significantly larger than a person alone can generate.

In the prior art, unsuccessful attempts to solve this problem were attempted, namely explosive means of driving the penetrator through the barrier or skin. Explosive means can not be used in an explosive atmosphere such as is found in most aircraft fires. Hydraulic means for forcing the penetrator through a barrier have been tried but this means requires a backing or fastening of one end of the penetrator to a secure area which may not be available. However, the problem was solved by the present invention because the penetration force is provided by a boom attached to a fire truck.

The present invention solved a long felt need for a penetration device that reliably can be used for confined fires and fires that are inaccessible.

Accordingly, it is an object of the present invention to provide a penetration device that includes a fluid dispersion means.

More particularly, it is an object of the present invention to provide a spray pattern which more effectively extinguishes interior fires.

In keeping with these objects, and with others which will become apparent hereinafter, one feature of the present invention resides, briefly stated, in a hardened tip designed to penetrate the skin of an aircraft.

In accordance with another feature of the present invention, is sidewards fogging nozzles.

Another feature of the present invention is fogging nozzles in the tip.

Yet another feature of the present invention is that it is mounted on a fire truck boom which provides the means to cause it to penetrate an object.

The novel features which are considered characteristic for the invention are set forth in the appended claims. The invention itself however, both as to its construction and its method of operation, together with additional objects and advantages thereof, will be best understood from the following description of the specific embodiments when read and understood in connection with the accompanying drawings.

BRIEF LIST OF REFERENCE NUMERALS UTILIZED IN THE DRAWINGS

10—aircraft penetrating nozzle (10)
12—shank (12)
12A—shank nipple (12A)
12B—shank frustum receptor (12B)

12C—shank (12C)
12CA—shank aperture (12CA)
12CAA—shank aperture cylindrical housing (12CAA)
14—source coupling (14)
14A—source coupling nipple (14A)
14B—source coupling shaft receptor (14B)
14C—source coupling shoulder (14C)
16—frustum (16)
16A—frustum coupling (16A)
16B—frustum tip receptor (16B)
16C—frustum housing (16C)
16D—at least one pair of shank apertures (16D)
16DA—frustum forward nozzle orifice (16DA)
16DB—frustum forward nozzle director (16DB)
16E—frustum side nozzle (16E)
18—penetrator (18)
18A—penetrator coupling (18A)
18B—penetrator tip (18B)
18C—penetrator body (1 8C)
20—rotating nozzle (20)
20A—spinner (20A)
20AA—spinner channel (20AA)
20AB—spinner aperture (20AB)
20ABA—spinner aperture outward end (20ABA)
20ABB—spinner clearance aperture (20ABB)
20ABC—spinner aperture inner end (20ABC)
20AC—spinner removal tool adapter (20AC)
20B—spinner bearing (20B)
20BA—spinner bearing aperture (20BA)
20C—washer (20C)
20CA—washer aperture (20CA)
20E—retaining nut (20D)
20DA—retaining nut aperture (20DA)
20E—rotating nozzle shaft (20E)
20EA—shaft retaining stud (20EA)
20EE—shaft spindle (20EB)
20EC—shaft spacer (20EC)
20ED—shaft shoulder (20ED)
20EE—shaft coupling (20EE)
20F—shaft mount (20F)
20FA—shaft mount aperture (20FA)
20FB—shaft mount conformal surface (20FB)
20FC—shaft mount top (20FC)

DETAILED DESCRIPTION OF THE PREFERRED EMBODIMENT

Figure 1:
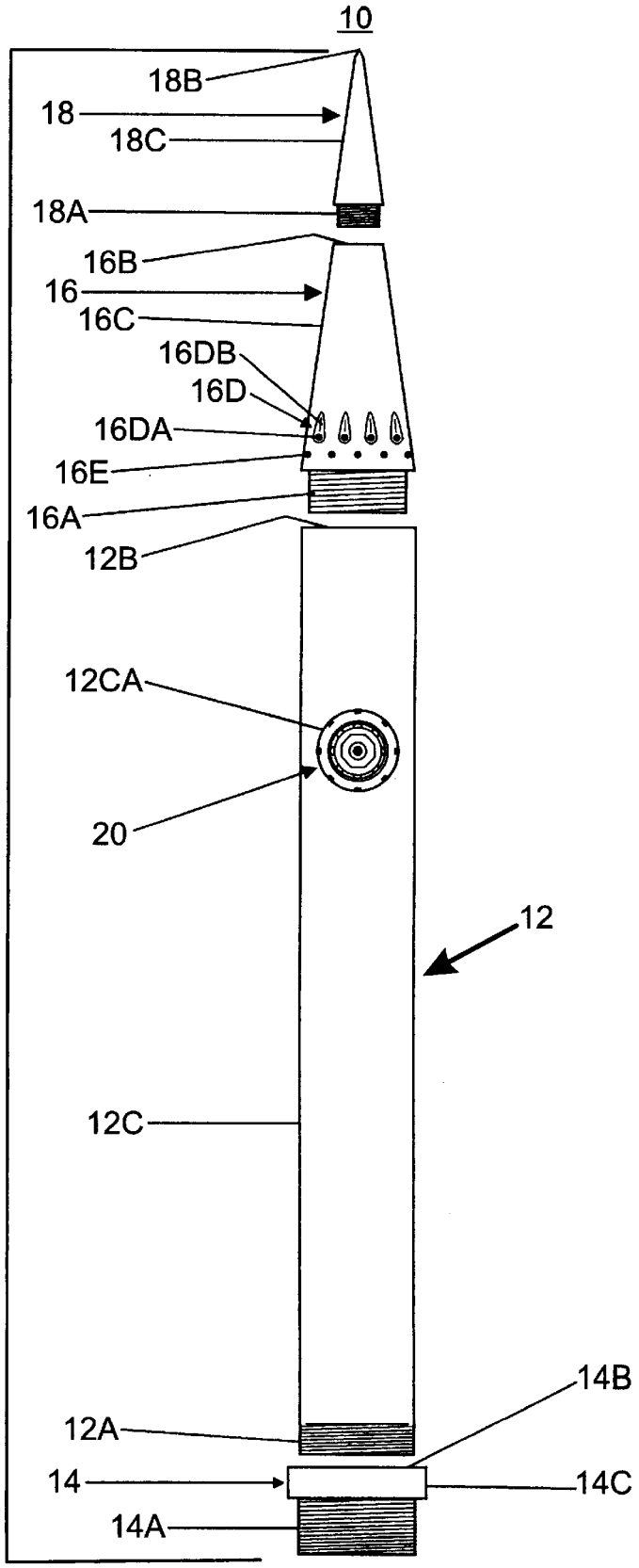
FIG. 1 is a side exploded view of an aircraft penetrating nozzle.

Firstly, referring to FIG. 1 which is a side exploded view, an aircraft penetrating nozzle (10) has the following features: shank (12), shank nipple (12A), shank frustum receptor (12B), shank (12C), shank aperture (12CA), source coupling (14), source coupling nipple (14A), source coupling shaft receptor (14B), source coupling shoulder (14C), frustum (16), frustum coupling (16A), frustum tip receptor (16B), frustum housing (16C), frustum forward nozzle (16D), frustum forward nozzle orifice (16DA), frustum forward nozzle director (16DB), frustum side nozzle (16E), penetrator (18), penetrator coupling (18A), penetrator tip (18B), penetrator body (18C), and rotating nozzle (20).

An aircraft penetrating nozzle (10) comprises a shank (12) having a shank nipple (12A) at one distal end. The shank nipple (12A) is adapted to cooperate with a source coupling shaft receptor (14B) to removably attach the shank (12) to a source coupling (14). The source coupling shaft receptor (14B) is securely attached to a source coupling (14). The source coupling (14) comprises a source coupling nipple (14A) which functions to removably attach the aircraft penetrating nozzle (10) to a water supply source. The shank (12) functions to carry fire extinguishing fluid from a source to at least one frustum side nozzle (16E), at least one rotating nozzle (20) and at least one frustum forward nozzle (16D). The source coupling (14) further comprises a source coupling shoulder (14C) which functions to limit the distance the source coupling (14) removably fastens to the water supply source.

The opposite distal end of the shank (12) comprises a shank frustum receptor (12B) which functions to cooperate with a frustum coupling (16A) to removably attach the shank (12) to a frustum (16). The frustum coupling (16A) is securely attached to a frustum housing (16C) at one distal end. The opposite distal end of the frustum housing (16C) comprises a frustum tip receptor (16B) which cooperates with a penetrator coupling (18A) to removably fasten the frustum (16) to a penetrator (18). The penetrator coupling (18A) is securely attached to a penetrator body (18C) at one distal end. The opposite distal end of the penetrator body (18C) comprises a penetrator tip (18B). The penetrator tip (18B) is adapted to a shape well known in the art for punching through metal. The penetrator tip (18B) is made from hardened materials.

The frustum housing (16C) comprises frustum side nozzle (16E) which functions to eject a stream of fire extinguishing fluid outwardly and perpendicular to the axis of the frustum housing (16C). The frustum housing (16C) further comprises a frustum forward nozzle orifice (16DA) positioned within a frustum forward nozzle director (16DB). The frustum forward nozzle director (16DB) functions to direct the stream of fire extinguishing fluid from the frustum forward nozzle orifice (16DA) in a forwardly direction producing a conical shaped total discharge from the frustum (16).

The shank (12) further comprises at least one pair of shank apertures (12CA) positioned juxtaposed on opposite sides of the shank (12). The at least one pair of shank apertures (12CA) are securely attached at an outer perimeter to a shank aperture cylindrical housing (12CAA, See FIGS. 7 and 8). The shank aperture cylindrical housing (12CAA) extends inwardly functioning as a shroud for and cooperates with the rotating nozzle (20) to direct the exhausting fire extinguishing fluid sidewards in fine droplets similar to a fog. The position of the aircraft penetrating nozzle (10) within the aircraft is typically perpendicular to the longitudinal axis. In this position the rotating nozzle (20) functions to direct the fire extinguishing fluid fore and aft in the aircraft.

Figure 2:
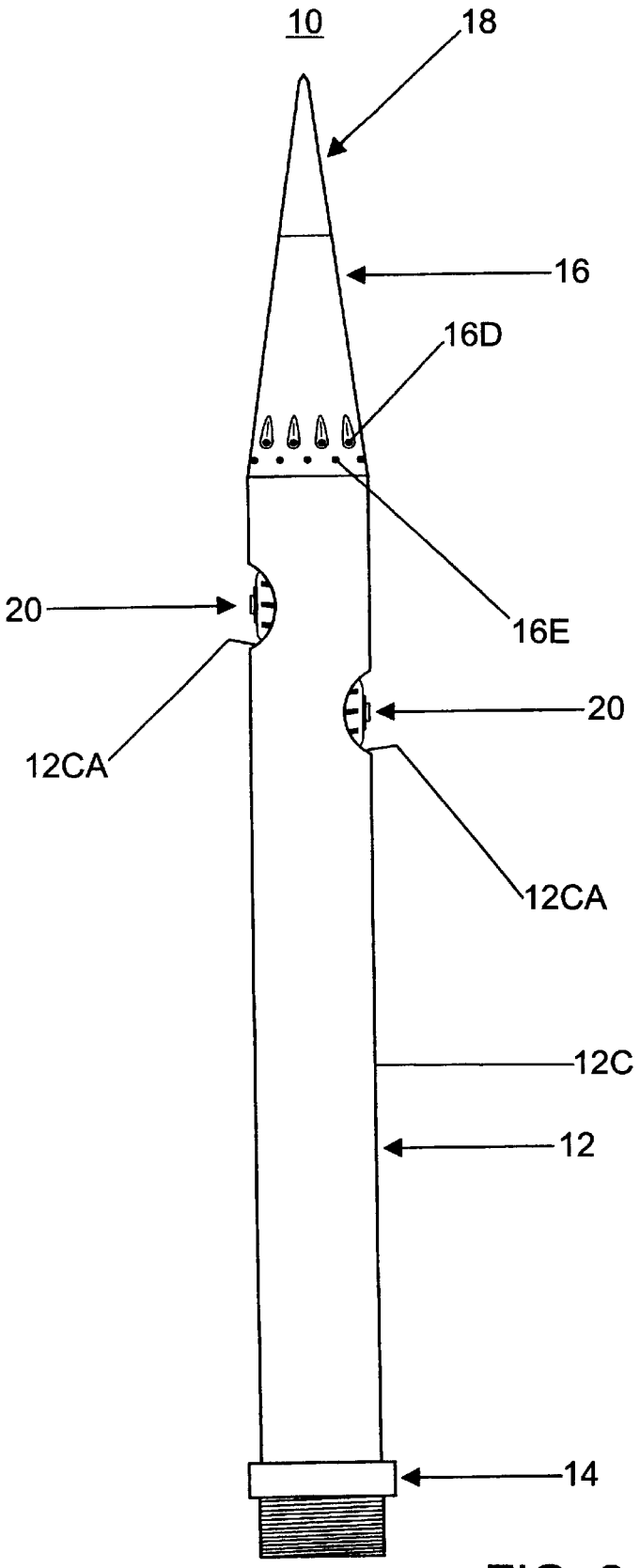
FIG. 2 is a side view of an aircraft penetrating nozzle.

Secondly referring to FIG. 2 which is a side view, of an aircraft penetrating nozzle has the following features: shank (12), shank (12C), shank aperture (12CA), source coupling (14), frustum (16), frustum housing (16C), frustum forward nozzle (16D), penetrator (18), and rotating nozzle (20).

Figure 3:
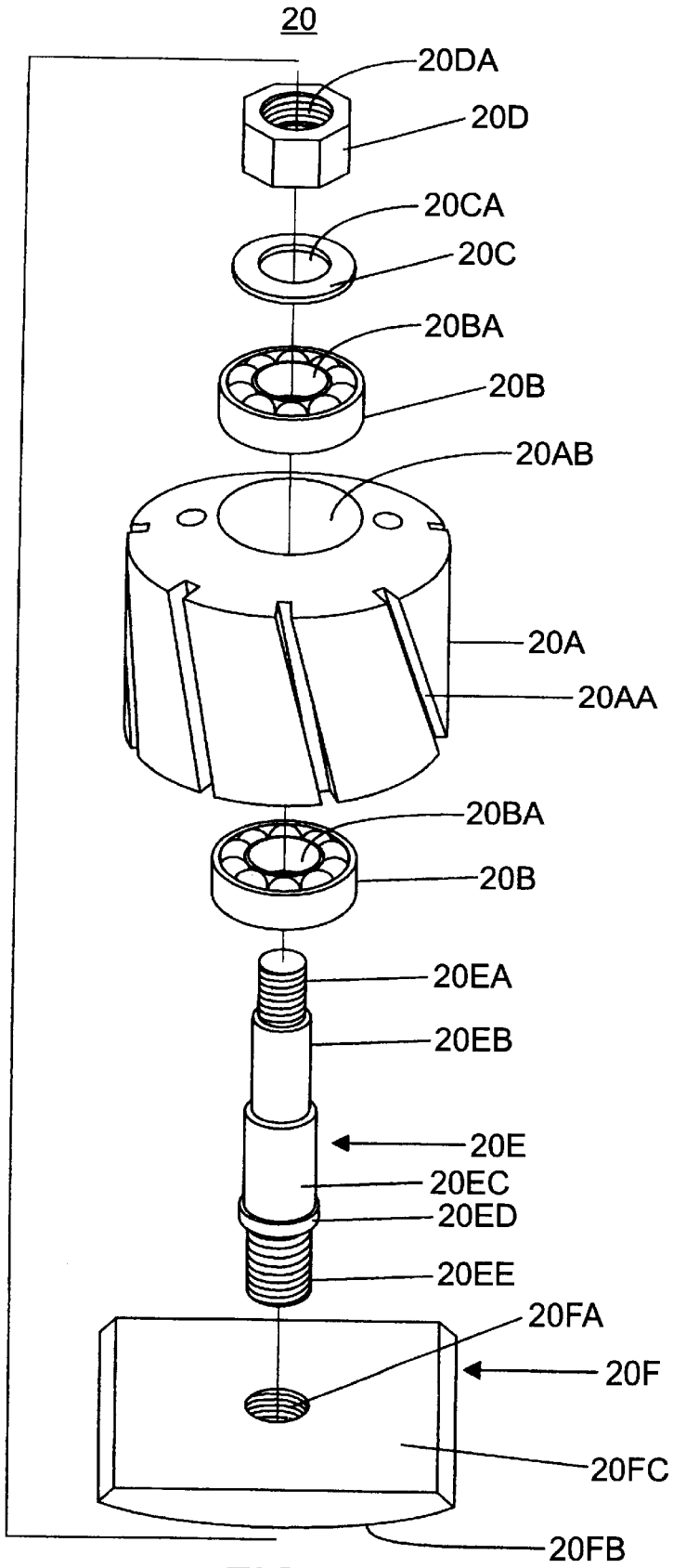
FIG. 3 is an exploded view of a rotating nozzle.

Referring now, thirdly, to FIG. 3 which is an exploded view, the rotating nozzle (20) has the following features: spinner (20A), spinner channel (20AA), spinner aperture (20AB), spinner bearing (20B), spinner bearing aperture (20BA), washer (20C), washer aperture (20CA), retaining nut (20D), retaining nut aperture (20DA), rotating nozzle shaft (20E), shaft retaining stud (20EA), shaft spindle (20EB), shaft spacer (20EC), shaft shoulder (20ED), shaft coupling (20EE), shaft mount (20F), shaft mount aperture (20FA), shaft mount conformal surface (20FB), and shaft mount top (20FC).

The rotating nozzle (20) comprises a spinner (20A) which is cylindrically shaped having a plurality of at least one spinner channel (20AA) cut into a perimeter side. The at least one spinner channel (20AA) functions to exhaust fire extinguishing fluids and impart a spin to the at least one spinner channel (20AA) which creates a fogging effect in the exhausting fire fighting fluid. The spinner (20A) has a spinner aperture (20AB) therethrough which is adapted at a spinner aperture outward end (20ABA) to receive at least one spinner bearing (20B). The at least one spinner bearing (20B) is fire extinguishing fluid lubricated. The at least one spinner bearing (20B) functions to absorb the thrust of the outwardly ejected fire extinguishing fluid providing a low friction rotational attachmnent of the spinner (20A) to a shaft spindle (20EB). The spinner (20A) is removably attached to the rotating nozzle shaft (20E) by a retaining nut (20D) having a retaining nut aperture (20DA) at a shaft retaining stud (20EA). A washer (20C), having a washer aperture (20CA) adapted to slidably attach to the shaft retaining stud (20EA), functions as an outward bearing surface for the at least one spinner bearing (20B).

The shaft retaining stud (20EA) is securely attached to an outer distal end of the shaft spindle (20EB). The shaft spindle (20EB) functions to receive the at least one spinner bearing (20B) at the at least one spinner aperture (20AB). The inner distal end of the shaft retaining stud (20EA) is securely attached to an outer distal end of a shaft spacer (20EC). The shaft spacer (20EC) functions to position the spinner (20A) within the shank aperture (12CA) to create a fogging discharge of fire extinguishing fluids. The inner distal end of the shaft spacer (20EC) is securely attached to a shaft shoulder (20ED) which functions as a stop to position the rotating nozzle shaft (20E) within the shank (12). The shaft shoulder (20ED) is securely attached to an outer distal end of a shaft coupling (20EE).

The shaft coupling (20EE) securely attaches to a shaft mount (20F) at a shaft mount aperture (20FA) centrally located in a shaft mount top (20FC) of the shaft mount (20F). The shaft mount (20F) comprises a shaft mount conformal surface (20FB) which cooperates with the interior wall of the shank (12) where it is securely fastened.

Figure 4:
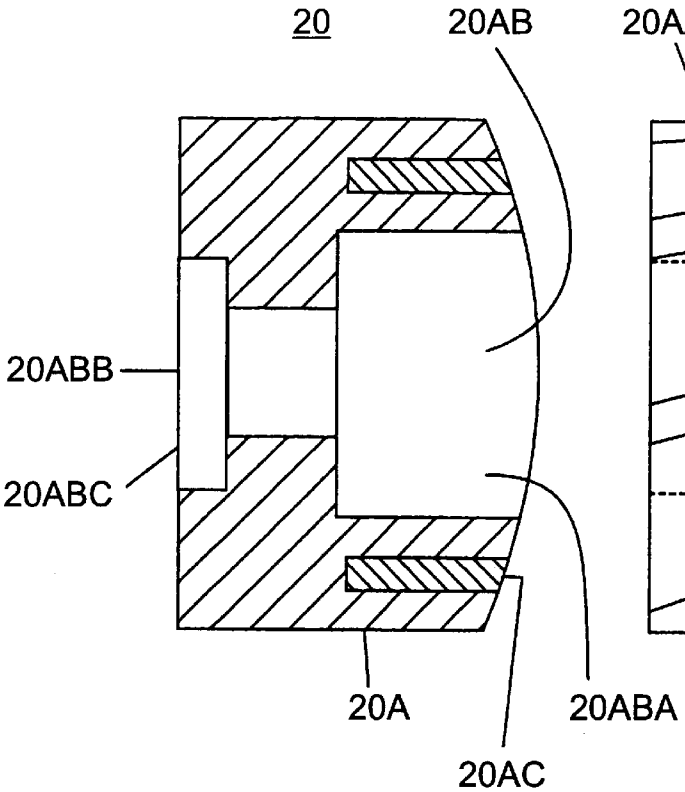
FIG. 4 is a cross section view of a spinner.

Now referring to FIG. 4 which is a cross section view, a spinner (20A) has the following features: spinner aperture (20AB), spinner aperture outward end (20ABA), spinner clearance aperture (20ABB), spinner aperture inner end (20ABC), and spinner removal tool adapter (20AC).

The spinner (20A) comprises the spinner aperture (20AB) having a spinner aperture outward end (20ABA) which is adapted to retain the at least one spinner bearing (20B). The spinner aperture (20AB) further comprises a spinner clearance aperture (20ABB) functioning to allow the passage of fire extinguishing fluids to lubricate the at least one spinner bearing (20B). The spinner aperture (20AB) still further comprises spinner aperture inner end (20ABC) which is adapted to retain the at least one spinner bearing (20B).

The spinner (20A) further comprises a spinner removal tool adapter (20AC) which is internally threaded to accept a removal tool which functions to remove the spinner (20A) from the rotating nozzle shaft (20E).

Figure 6:
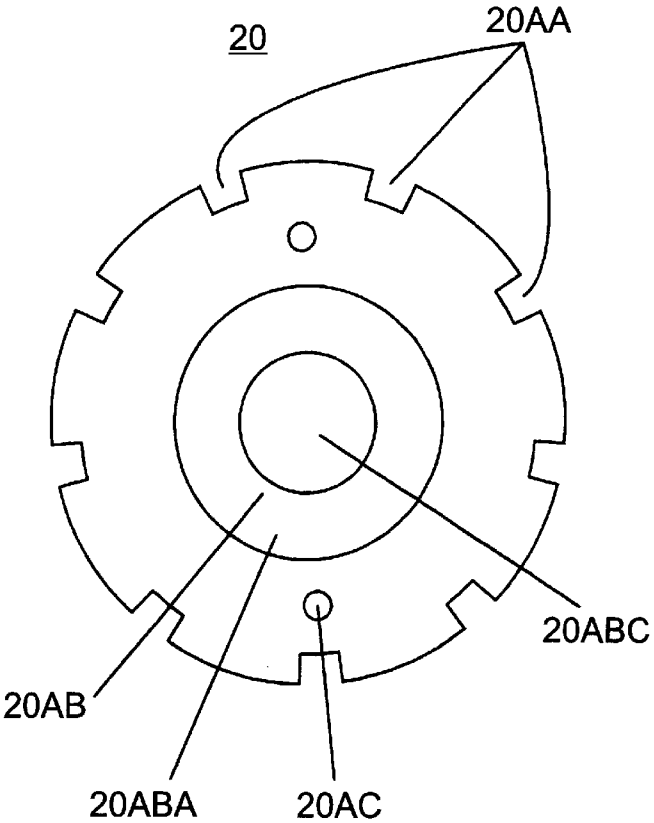
FIG. 6 is a top view of a spinner showing the spinner channels, spinner aperture outward end, and spinner clearance aperture.
Figure 5:
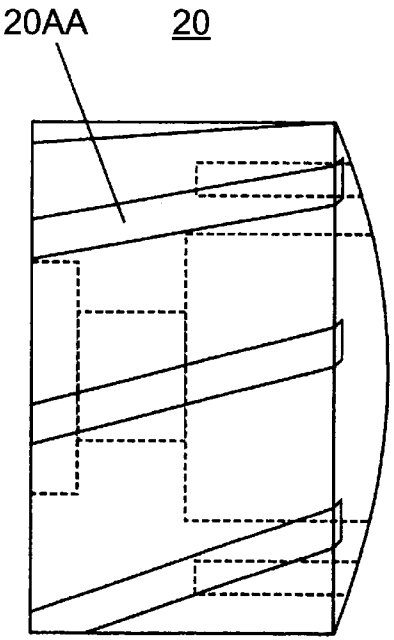
FIG. 5 is a side view of a spinner showing the spinner channels.

FIG. 5 and FIG. 6 are side and end views respectively of the spinner (20A) showing the spinner channel (20AA).

At least one spinner channel (20AA) is cut into the outer perimeter of the spinner (20A). The at least one spinner channel (20AA) functions to channel fire extinguishing fluid from the interior of the shank (12) outwardly. The outwardly discharge in the direction of the at least one spinner channel (20AA) creates a rotating force which causes the spinner (20A) to rotate at a high speed causing the discharged fluid to break into small droplets.

Figure 7:
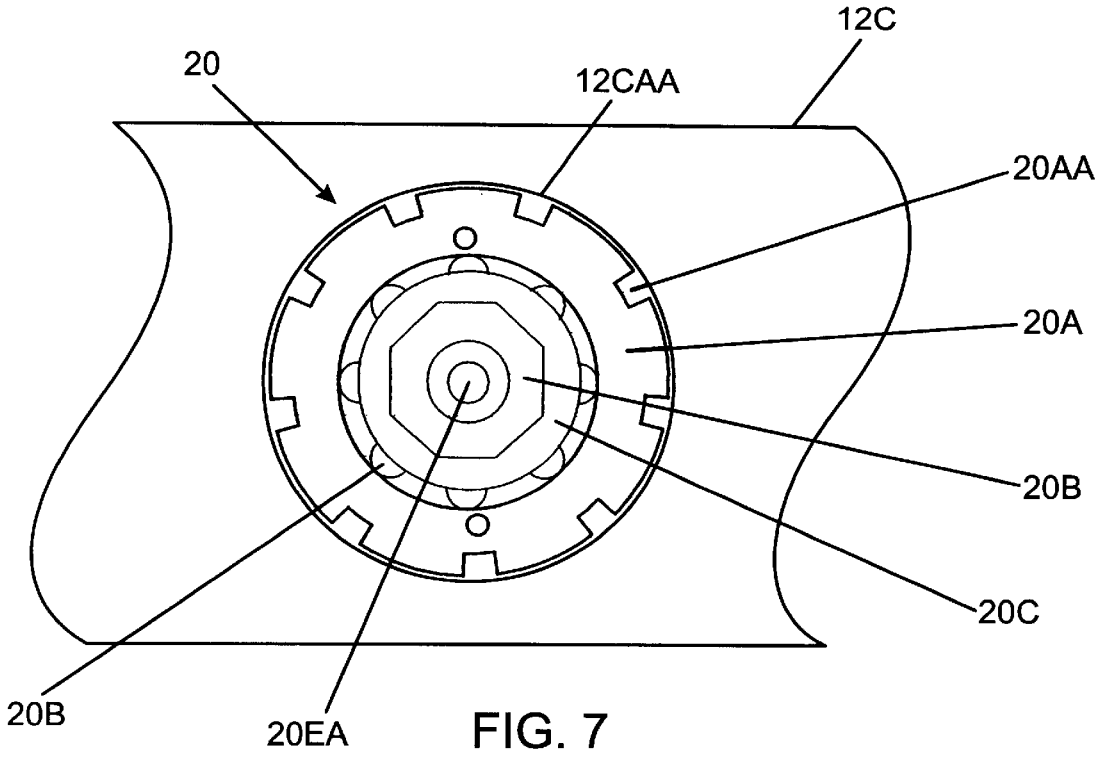
FIG. 7 is an end view of a spinner located in a shank aperture.
Figure 8:
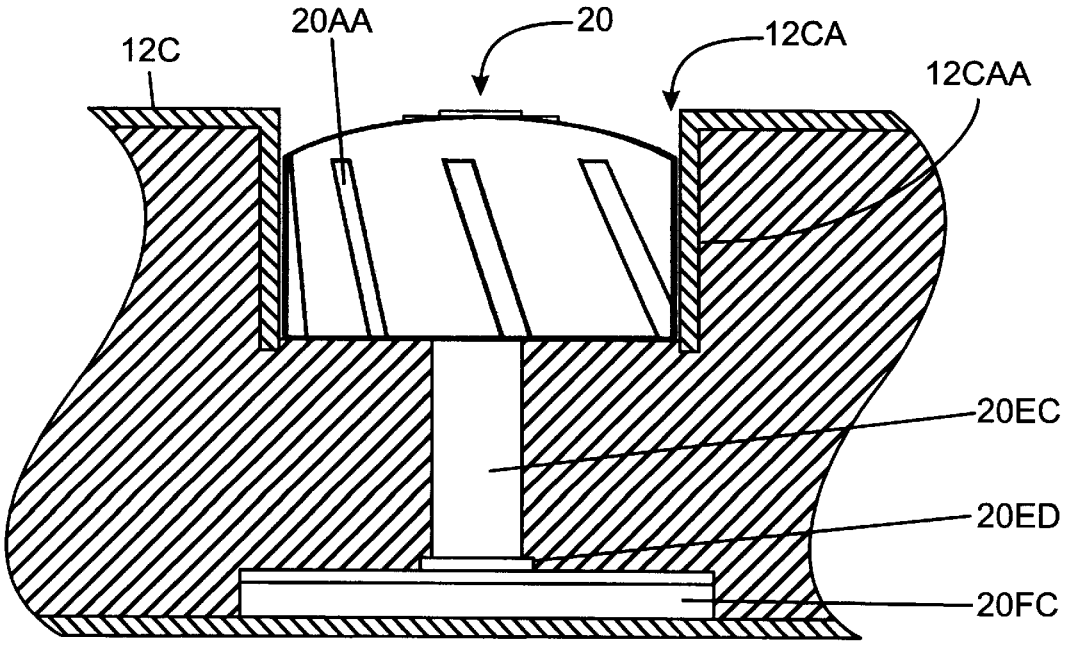
FIG. 8 is a cross section view of a shank through a shank aperture showing a rotating nozzle mounted therein.

Now referring to FIG. 7 and FIG. 8 together, FIG. 7 is an end view of a rotating nozzle (20) located in a shank aperture (12CA). FIG. 8 is a cross section view of a shank (12C) through a shank aperture (12CA) showing a rotating nozzle (20) mounted therein.

The shank (12C) comprises the shank aperture (12CA) having the shank aperture cylindrical housing (12CAA) securely attached at an outside perimeter. The shank aperture cylindrical housing (12CAA) forms a close fit with the rotating nozzle (20), particularly the spinner (20A). Fire extinguishing fluid under pressure is forced through the at least one spinner channel (20AA). Since the fire extinguishing fluid exhausts the at least one spinner channel (20AA) under pressure and at an upwardly sloping angle, the exhaust forces cause the spinner (20A) to rotate. The rotational velocity imparted to the exhausting fluid combined with the sudden depressurization causes the fluid to break into small droplets functioning to fog the interior of a chamber penetrated by the aircraft penetrating nozzle (10).

The spinner (20A) is adapted at a spinner aperture outward end (20ABA) to receive at least one spinner bearing (20B). The at least one spinner bearing (20B) is fire extinguishing fluid lubricated. The at least one spinner bearing (20B) functions to absorb the thrust of the outwardly ejected fire extinguishing fluid providing a low friction rotational attachment of the spinner (20A) to a rotating nozzle shaft (20E). The spinner (20A) is removably attached to the rotating nozzle shaft (20E) by the retaining nut (20D) and the washer (20C) which functions as an outward bearing surface for the at least one spinner bearing (20B).

It will be understood that each of the elements described above, or two or more together, may also find an useful application in other types of constructions differing from the type described above.

While the invention has been illustrated and described as embodied in an aircraft Penetrator, it is not intended to be limited to the details shown, since it will be understood that various omissions, modifications, substitutions, and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. An aircraft penetrating nozzle comprising:

A) a penetrator wherein the penetrator comprises a penetrator tip at one end of a penetrator body, an opposite distal end of the penetrator body is securely attached to a penetrator coupling, the penetrator functions to open a passageway in a barrier or skin of an aircraft to permit the aircraft penetrating nozzle to pass thereinto, and the penetrator coupling functions to join the penetrator to a proximal end of a frustum;

B) wherein the frustum comprises a frustum tip receptor functioning to receive the penetrator coupling, the frustum tip receptor is securely attached to a proximal end of a frustum housing, a distal end of the frustum housing is securely attached to a frustum coupling which functions to join the frustum to a shank having an outer perimeter, the frustum housing comprises a plurality of frustum forward nozzle orifices located within a plurality of frustum forward nozzle directors, the plurality of frustum forward nozzle orifices function as exhaust ports for pressurized fire extinguishing fluid, the plurality of frustum forward nozzle directors cause the pressurized fire extinguishing fluid to escape at an angle less than perpendicular to an axis of the frustum housing in a direction toward the penetrator which creates a cone-shaped discharge, the frustum housing further comprises a plurality of frustum side nozzles arranged around a perimeter of the frustum housing, and the plurality of frustum side nozzles function to cause the pressurized fire extinguishing fluid to escape perpendicular to the frustum housing axis creating a ring-shaped discharge;

C) wherein the shank comprises a shank frustum receptor on one end which functions to receive the frustum coupling, the shank further includes a shank nipple at an opposite end of the shank functioning to removably attach the shank to a source coupling, the shank further includes at least one shank aperture having a shank aperture cylindrical housing securely attached at the outer perimeter, and at least one shank aperture functions as a port for at least one rotating nozzle; and D) wherein the source coupling comprises a source coupling shaft receptor, securely attached at one end and adapted to receive the shank nipple, a source coupling nipple is securely attached at an opposite end of the source coupling and functions to removably attach the aircraft penetrating nozzle to a fire extinguishing fluid source, and a source coupling shoulder is securely attached at an upper distal end of the source coupling nipple.

2. The aircraft penetrating nozzle as described in claim 1 wherein the rotating nozzle comprises a shaft mount securely attached at an inner wall of the shank at a location opposite the shank aperture, the shaft mount comprises a shaft mount aperture which is securely attached to a rotating nozzle shaft by a shaft coupling, the shaft coupling is securely attached to a proximal end of a shaft shoulder which functions as a stop, a distal end of the shaft shoulder is securely attached to a proximal end of a shaft spacer which functions to position a spinner within the shank aperture cylindrical housing, a distal end of the shaft spacer is securely attached to a proximal end of a shaft spindle, the shaft spindle receives at least one spinner bearing having a spinner bearing aperture therein, the at least one spinner bearing is securely and removably attached to a spinner aperture centrally bored therethrough the spinner, the spinner comprises at least one spinner channel around an outer perimeter, the at last one spinner channel is slanted at an angle with respect to an axis of the spinner, the at least one spinner channel functions in close proximity to the shank aperture cylindrical housing to create a high pressure exit for fire extinguishing fluid, the angle of the at least one spinner channel causes a rotational force to be applied to the spinner causing the spinner to rotate about the shaft spindle, and an opposite distal end of the shaft spindle is securely attached to a shaft retaining stud which functions in cooperation with a washer and a retaining nut to securely restrain the spinner.

3. The aircraft penetrating nozzle as described in claim 1, wherein the penetrator tip is manufactured from metal alloys.

* * * * *